United States Patent [19]

Obram

[11] Patent Number: 4,799,679

[45] Date of Patent: Jan. 24, 1989

[54] REFLEX MOUNTING ASSEMBLIES FOR A BASKETBALL GOAL

[76] Inventor: Hugo A. Obram, 309 W. Walnut, Millington, Ill. 60537

[21] Appl. No.: 112,505

[22] Filed: Oct. 22, 1987

[51] Int. Cl.[4] ..... A63B 63/08

[52] U.S. Cl. ..... 273/1.5 R

[58] Field of Search ..... 273/1.5 R; 248/596, 248/598, 548, 549

[56] References Cited

U.S. PATENT DOCUMENTS

| | | | |
|---|---|---|---|
| 4,348,022 | 9/1982 | O'Donnell | 273/1.5 R |
| 4,365,802 | 12/1982 | Ehrat | 273/1.5 R |
| 4,433,839 | 2/1984 | Simonseth | 273/1.5 R |
| 4,438,923 | 3/1984 | Engle et al. | 273/1.5 R |
| 4,441,709 | 4/1984 | Schroeder et al. | 273/1.5 R |
| 4,483,534 | 11/1984 | O'Donnell | 273/1.5 R |
| 4,575,079 | 3/1986 | De Faveri | 273/1.5 R |
| 4,583,732 | 4/1986 | Allen | 273/1.5 R |
| 4,676,503 | 6/1987 | Mahoney | 273/1.5 R |

*Primary Examiner*—Paul E. Shapiro

*Attorney, Agent, or Firm*—Leydig, Voit & Mayer

[57] ABSTRACT

Reflex mounting assemblies for a basketball goal are provided which comprise: (a) a base plate normally attached to the front face of the backboard; (b) an L-shaped bracket which comprises a normally horizontal portion, to which a hoop is attached, and a normally vertical portion normally resting against the front face of the upper portion of the base plate; (c) a hinge for pivotally connecting the lower edge of the normally vertical portion of the L-shaped bracket to an interior region of the front face of the base plate; and (d) a pre-loaded resilient mass disposed between the lower face of the normally horizontal portion of the L-shaped bracket and the front face of the lower portion of the base plate.

12 Claims, 3 Drawing Sheets

PRIOR. ART

REFLEX MOUNTING ASSEMBLIES FOR A BASKETBALL GOAL

TECHNICAL FIELD

This invention is related generally to basketball goals, and more particularly, to reflex mounting assemblies for a basketball goal.

BACKGROUND OF THE INVENTION

Though it goes by various appellations the dunk, slam, or jam, this shot is one of the most spectacular in the game of basketball. During the course of a monster jam, however, there frequently is violent, forceful contact of the player's hands with the goal. If the goal is rigidly mounted, that contact can damage the goal and, potentially, the player's hands. Accordingly, it is common today for basketball goals to be reflexably mounted to the backboard whereby the goal hoop can be deflected downward during a dunk, but will resume its normal horizontal position thereafter, all without damage to the goal.

Children typically are very impressed with the acrobatics and power of the slam dunk, and with scaled-down, beginner basketball equipment, will attempt to play above the rim at every opportunity. There is, therefore, a real need for reflex mounting assemblies for beginner, nonregulation basketball goals. Unfortunately, conventional reflex mounting assemblies suffer one or more of a number of defects, especially when used with beginner equipment.

The prior art reflex mounting assembly shown in FIGS. 1–2, which is designed for use with beginner equipment, may be used to highlight the deficiencies of many conventional devices. As shown therein, the reflex mounting assembly 30 comprises an L-shaped bracket 31 pivotally attached to a backboard 20 by a hinge 32. The hinge pin 33*a* is an integral part of a pair of rigid braces 33 disposed, respectively, between each side of the vertical portion 31*a* of the L-shaped bracket 31 and the corresponding side of the hoop 11. The hoop 11 is attached to the horizontal portion 31*b* of the L-shaped bracket 31.

A compression spring assembly 34 comprising a compression spring 35 and a nut 36, bolt 37, and various washers passes through suitably designed apertures in the backboard 20 and the vertical portion 31*a* of the L-shaped bracket 31. Accordingly, when the hoop 11 is subjected to a downward force, the spring 35 resists the downward force with an opposing force transmitted between the front face of the vertical portion 31*a* of the pivoting L-shaped bracket 31 and the stationary washer 38. Upon termination of the downward force, the compression spring assembly acts to return the goal 10 to its normal horizontal position.

Initially it should be noted that the compression spring assembly 34 must be assembled by the user during the process of mounting the goal 10 to the backboard 20. Unfortunately, it comprises a number of parts which can be lost or misassembled. Even apart from such problems, however, installation of the spring assembly 34 is not necessarily a straightforward matter. The spring assembly 34 must support the hoop 11 in an essentially horizontal position, and it must do so with sufficient force to keep the hoop 11 substantially stable during normal impact with a basketball. At the same time, it should not be so firm that the hoop 11 is not easily deflected by contact incidental to a dunk shot.

The force imparted by the spring assembly 34 is controlled by loading the spring, i.e., tightening the nut 36 on the threaded bolt 37. This loading, of course, must be accomplished by a consumer who may find it difficult or impossible to determine the appropriate degree of loading. Accordingly, even if the spring assembly 34 is not misassembled, the consumer invariably is put to greater effort in mounting the goal.

The complexity of conventional mounting assemblies for regulation equipment usually is even greater, e.g., as disclosed in U.S. Pat. No. 4,676,503 to E. Mahoney et al. and U.S. Pat. No. 4,483,544 to J. O'Donnell. Such designs are more difficult and costly to manufacture, and thus, really are too expensive to be used with beginner equipment. Installation of regulation mounting assemblies often is even more complicated than that of the still complex, but more simple design shown in FIGS. 1–2.

Moreover, the compression spring assembly 34 of the mounting assembly shown in FIGS. 1–2 protrudes out from the face of the vertical portion 31*a* of the L-shaped bracket 31. Many conventional mounting assemblies for regulation equipment also comprise protruding parts, e.g., as disclosed in U.S. Pat. No. 4,441,709 to E. Schroeder et al. and U.S. Pat. No. 4,433,839 to J. Simonseth. Such protruding parts create a risk of injury to player's hands, particularly those of younger, more inexperienced players who also may be playing with non-regulation equipment at much lower goal heights.

Finally, it also should be noted that the rim typically will be released quite suddenly, so that the hoop will spring back to the horizontal position with considerable momentum. In the prior art device shown in FIGS. 1–2, therefore, the vertical portion 31*a* of the L-shaped bracket 31 can strike the backboard 20 with such force that backboards made from more frangible materials, such as press board, which for cost factors is otherwise a preferred material in beginner equipment, eventually are damaged. This problem is only exacerbated when the spring assembly 34 is overloaded by an unsophisticated consumer.

An object of this invention, therefore, is to provide a reflex mounting assembly which is more simple in design, more easily and cheaply manufactured, and more easily installed by the user.

A further object of the subject invention is to provide a reflex mounting assembly having a minimum number of projecting, metallic parts upon which players may injure themselves.

Yet another object of the subject invention is to provide a reflex mounting assembly wherein wear on the backboard is reduced.

It also is an object of the subject invention to provide a reflex mounting assembly wherein all of the above mentioned advantages are realized.

These and other objects and advantages of the invention will be apparent to those skilled in the art upon reading the following detailed description and upon reference to the drawings.

SUMMARY OF THE INVENTION

The invention provides for an assembly for reflexably mounting a normally horizontal basketball goal hoop to a vertical backboard, which reflex mounting assembly comprises (a) a base plate normally attached to the front face of the backboard; (b) an L-shaped bracket which comprises a normally horizontal portion, to which a hoop is attached, and a normally vertical portion normally resting against the front face of the upper portion of the base plate; (c) a hinge for pivotally connecting the lower edge of the normally vertical portion of the L-shaped bracket to an interior region of the front face of the base plate; and (d) a preloaded resilient mass disposed between the lower face of the normally horizontal portion of the L-shaped bracket and the front face of the lower portion of the base plate.

DETAILED DESCRIPTION OF THE INVENTION

Figure 1A:
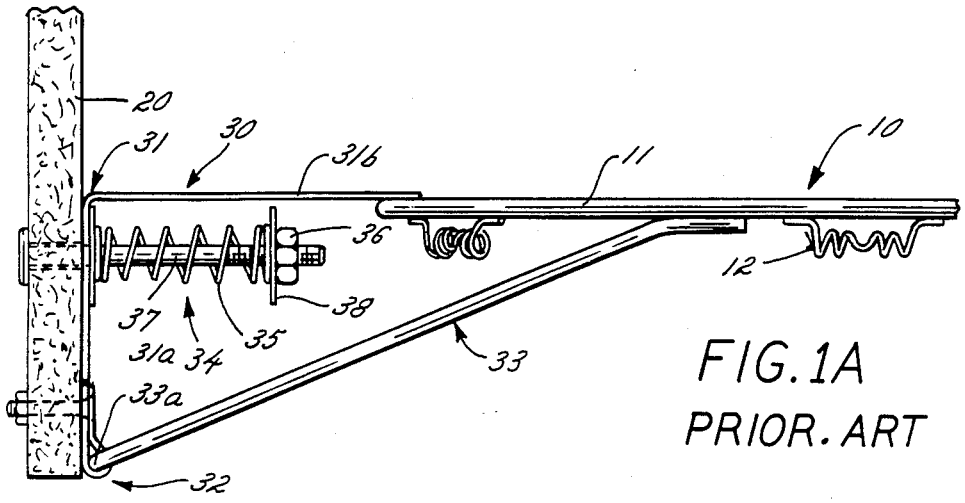
FIGS. 1A and 1B are partial side elevational views of a prior art reflex mounting assembly attached to a basketball backboard, which views, respectively, show the basketball goal hoop in its normal horizontal position and in a deflected position.
Figure 1B:
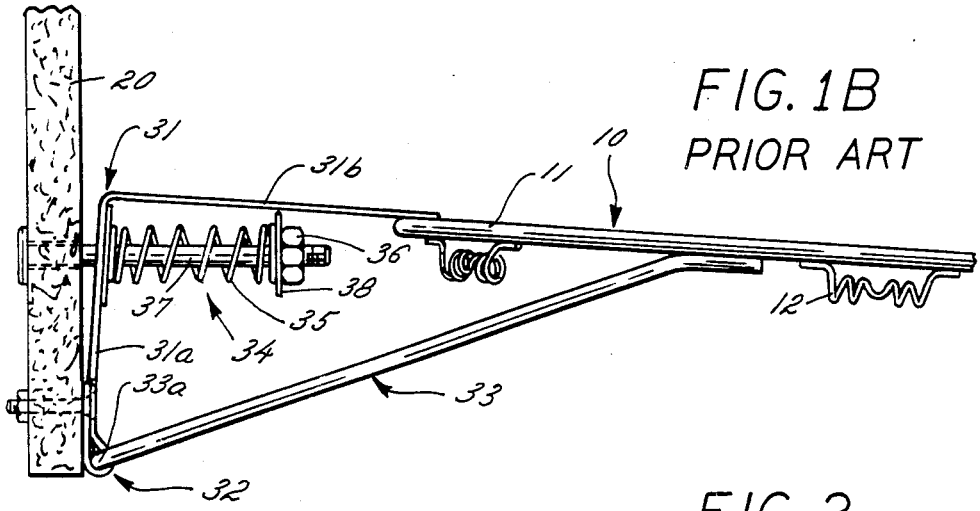
FIG. 1B PRIOR ART
Figure 2:
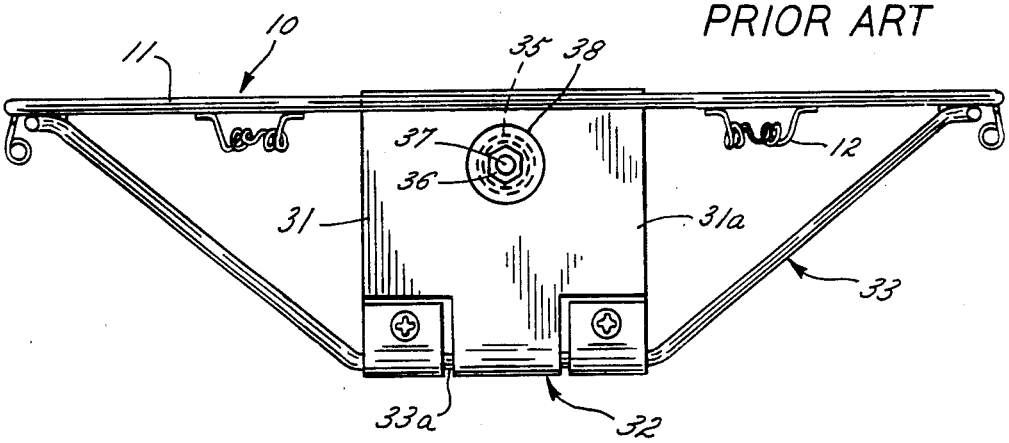
FIG. 2 PRIOR ART
FIG. 2 is a front elevational view of the prior art reflex mounting assembly shown in FIG. 1 in which the reflex mounting assembly is detached from the backboard.
Figure 3:
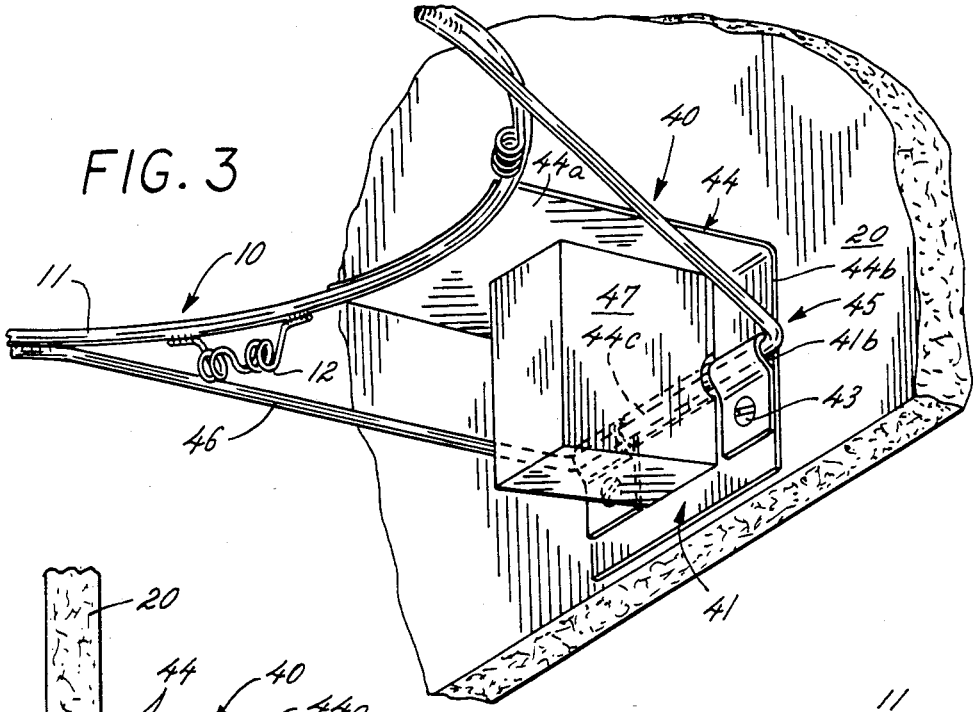
FIG. 3 is a partial perspective view of a preferred embodiment of the reflex mounting assemblies of the subject invention which is attached to a basketball backboard and wherein the hinge is disposed at an interior region of the front face of the base plate and at the lower edge of the normally vertical portion of the L-shaped bracket.
Figure 4A:
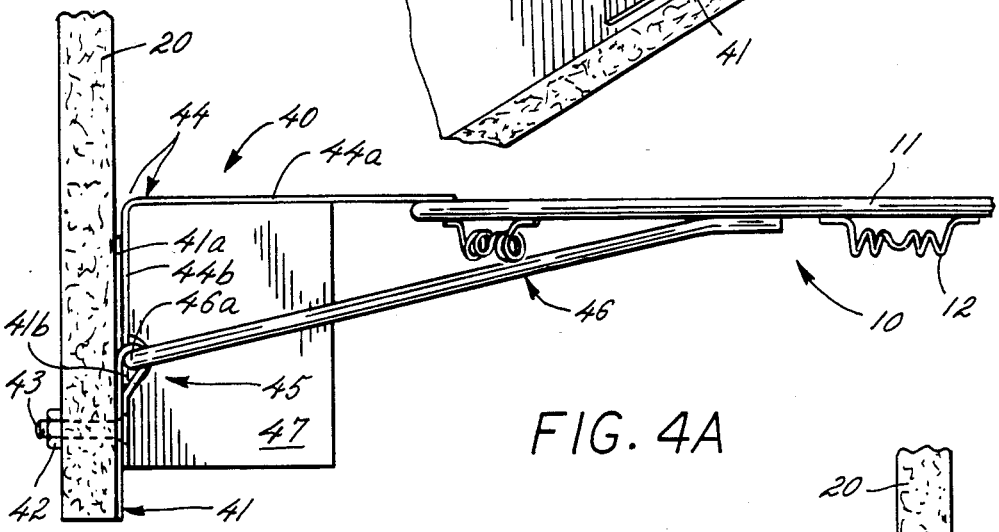
FIGS. 4A and 4B are partial side elevational views of the reflex mounting assembly shown in FIG. 3, which views, respectively, show the basketball goal hoop in its normal horizontal position and in a deflected position.
Figure 4B:
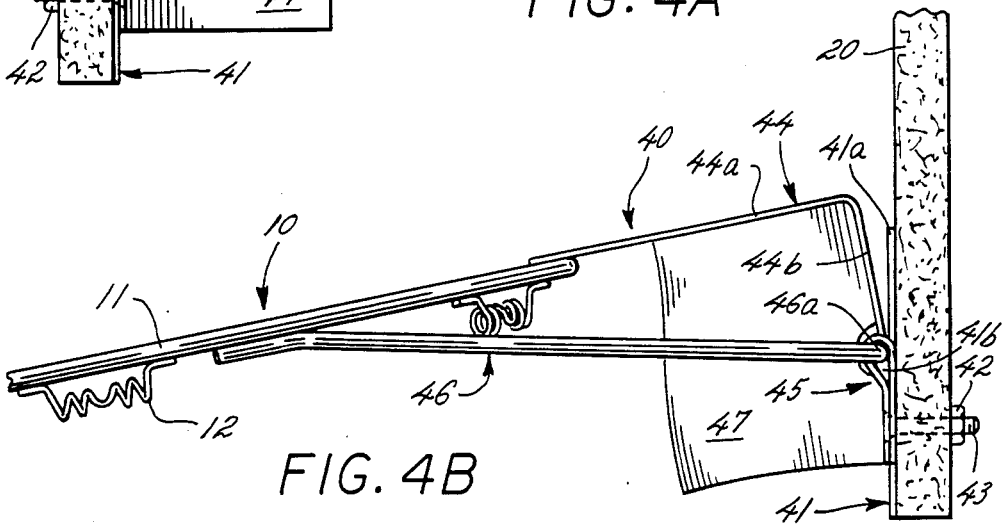
Figure 5:
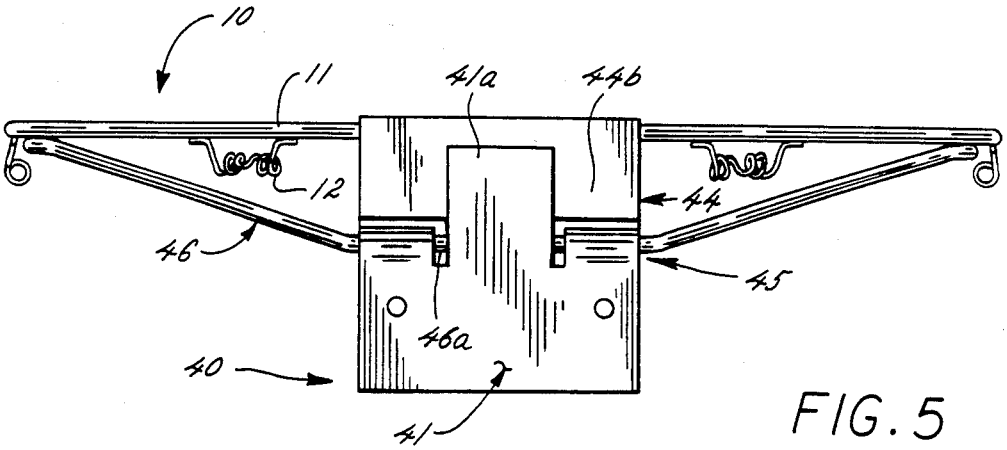
FIG. 5 is a rear elevational view of the reflex mounting assembly shown in FIG. 3 wherein the reflex mounting assembly is detached from the backboard.
Figure 6:
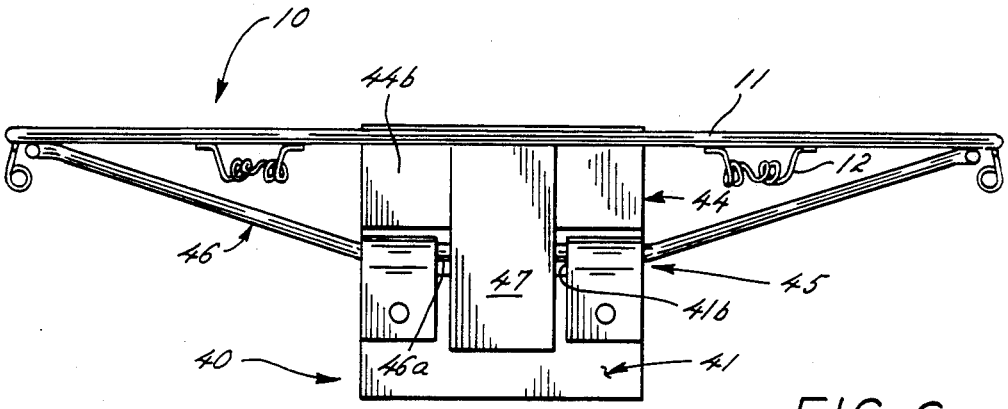
FIG. 6 is a front elevational view of the unattached reflex mounting assembly shown in FIG. 3.

As will become more apparent from the discussion below, the reflex mounting assemblies of the subject invention are simple in design, easily manufactured, and are readily installed by the consumer. Moreover, they have a minimum number of projecting, metallic parts and thereby reduce the risk of accidental injury to players. Finally, the inventive reflex mounting assemblies are such that wear on relatively frangible backboards is reduced.

As shown in FIGS. 3–6, a basketball goal 10 is mounted to a backboard 20 through a preferred reflex mounting assembly 40 of the subject invention. The goal 10 comprises a hoop 11 having hooks 12 by which a net (not shown) is suspended from the hoop 11.

The reflex mounting assembly 40 comprises a base plate 41 which normally, i.e., during use, is attached to the front face of the backboard 20. The base plate 41 is generally rectangular, except for a generally rectangular upper portion 41*a*. It is not necessary, however, that the base plate 41 have the precise shape best shown in FIG. 5. Other shapes, such as where the sides of the base plate 41 are tapered or where the lower edge of the base plate 41 and the upper edge of its upper portion 41*a* are rounded, may be used which also enable the base plate 41 to serve its function described in more detail below. Suitable means for attaching the base plate 41 to the backboard are provided, and in this preferred embodiment they are a pair of nuts and bolts 42, 43.

The reflex mounting assembly 40 further comprises a substantially L-shaped bracket 44 having a normally horizontal portion 44*a* to which the hoop 11 is attached. The L-shaped bracket 44 also comprises a normally vertical portion 44*b* which normally rests against the front face of the upper portion 41*a* of the base plate 41. It will be understood that in referring to the "normal" orientation of the L-shaped bracket 44 and the portions thereof that what is being described is the orientation of the component while the goal 10 is not being subjected to a downward force.

A hinge 45 is provided for pivotally connecting the lower edge of the vertical portion 44*b* of the L-shaped bracket 44 to an interior region of the front face of the base plate 41. The cooperating passageways 41*b* and 44*c* (best shown in see-through lines in FIG. 3) of the hinge 45, respectively, are integral parts of the base plate 41 and the L-shaped bracket 44, those passageways being formed by folding over a portion of the base plate 41 and the L-shaped bracket 44. Similarly, the pin 46*a* of the hinge 45 is an integral part of a pair of rigid braces 46 disposed, respectively, between each side of the hoop 11 and the corresponding sides of the vertical portion 44*b* of the L-shaped bracket 44. It should be noted, however, that it is not necessary for the cooperating passageways and pins of the hinge to be formed as integral parts of any other component. They may be formed separately and attached to the base plate and L-shaped bracket, although it is believed that their integral construction as shown in the preferred embodiment of FIGS. 3–6 permits greater ease and simplicity of manufacture.

The braces 46 are not strictly necessary, but as a practical matter, it is highly desirable to include some sort of bracing to reinforce the attachment of the hoop 11 to the horizontal portion 44*a* of the L-shaped bracket 44 and thereby increase the durability of the attachment and that of the hoop 11 as well. Many conventional brace designs are known and may be used, particularly if it is not desired to form the hinge pin as an integral part of the braces. Such bracing, if desired, preferably is disposed between the hoop 11 and the vertical portion 44*b* of the L-shaped bracket 44, and it will be understood that for purposes of this description, the hinge point shall be considered part of the vertical portion 44*b*.

The reflex mounting assembly 40 further comprises a resilient mass 47 disposed between the lower face of the horizontal portion 44*a* of the L-shaped bracket 44 and the front face of the lower portion of the base plate 41. It may be attached thereto by any suitable means, e.g., adhesives, and it is preloaded. That is, the resilient mass 47 is attached in a compressed state so as to impart a force between the lower face of the horizontal portion 44*a* of the L-shaped bracket and the front face of the lower portion of the base plate 41 when the hoop 11 is in its normal horizontal position. The degree of compression may vary according to the composition and shape of the resilient mass, but the preloaded force should be sufficient to maintain the hoop 11 in an essentially horizontal position and to stabilize it during normal contact with a basketball. It should not be so great, however, that the hoop 11 is not easily deflected by contact with a players hands during a slamma-jamma.

The resilient mass 47 may be composed of any material which is resilient, yet firm enough such that it is capable of providing an appropriate preloaded force. It also should be resilient enough to return the hoop 11 to an essentially horizontal position during the normal interval between shots. Accordingly, the resilient material may be selected from a variety of well known compositions, including natural rubber, neoprene rubber, and polyurethane. Because they can be molded, are durable, and have long memory retention, polyurethanes, i.e., polyurethane and its copolymers with various other monomers, are especially preferred. Suitable polyurethanes are available commercially, e.g., from Mobay Chemical Company, Pittsburgh, Pa., and Anderson Development Company, Adrian, Mich. More specifically, Cyanaprene A-9 TM, a polyester based toluene diisocyanate terminated polyurethane prepolymer available from American Cyanamide Company, Wayne, N.J., has been found to provide satisfactory results.

Figure 7:
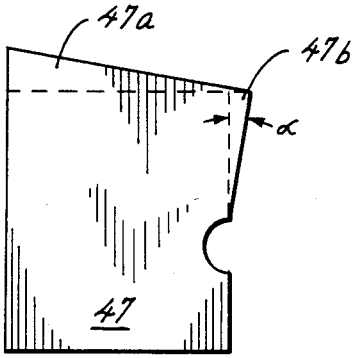
FIG. 7 is a side elevational view of the resilient mass disassembled from the reflex mounting assembly shown in FIG. 3, wherein the unloaded and, in dotted lines, preloaded configuration of the resilient mass is shown.

As shown in FIGS. 3–6, the resilient mass 47 in its preloaded condition is of substantially solid rectangular shape with a passage way being formed therein to accommodate the hinge 45. As more clearly shown in FIG. 7, the resilient mass 47, before preloading, has portions 47*a* and 47*b* which "extend" at an angle $\alpha$ from the generally solid rectangular preload shape, which preload shape is shown therein in dotted lines. When the preloaded resilient mass 47 is approximately $2'' \times 1\frac{1}{2}'' \times 1''$ and is composed of Cyanaprene A-9 TM polyurethane, satisfactory preloading was obtained when the angle $\alpha$ is approximately 10°. The angle $\alpha$ and the degree of compression, however, will vary according to the choice of material. Moreover, the configuration of the preloaded and unloaded resilient mass may vary from that shown in FIGS. 3–7 so long as the resilient mass is capable of imparting the required resiliency and preload force between the lower face of the horizontal portion 44*a* of the L-shaped bracket 44 and the front face of the lower portion of the base plate 41.

The goal 10, backboard 20, and remaining components of the reflex mounting assembly 40 may be fabricated by well known methods from conventional materials. The hoop 11 and hooks 12, for example, may be composed of steel and welded together. Similarly the braces 46 and the L-shaped bracket 44 also may be composed of steel and may be welded together. As for the backboard 20, it may be composed of wood, steel, composite board, or any number of other rigid materials. In any event, it should be readily appreciated that in large part because of its simple design and minimal number of parts, the reflex mounting assemblies of the subject invention are easily and cheaply manufactured. Moreover, because they can be completely assembled and preloaded prior to sale, the ultimate consumer can more easily install the goal to the backboard, e.g., by simply installing a pair of nuts and bolts as reflected in FIGS. 3–6.

The reflex mounting assemblies of the subject invention may be used with regulation-size goals, backboards, and basketballs, i.e., equipment meeting high school, N.C.A.A., or professional regulations and the like, but they are especially desirable for use with scaled-down, beginner equipment wherein the mounting assemblies are likewise scaled-down and nonregulation in size. Because they can be manufactured easily and cheaply, they are available to consumers who wish to provide their children with a beginner set, but who otherwise would not consider a more complex, costly design. Moreover, since beginners by definition do not have the coordination and skill of advanced players, and hence, as great an ability to minimize the likelihood of self-inflicted injury, it will be appreciated that the reflex mounting assemblies of the subject invention provide for a minimal number of protruding metal parts on which such injury may be inflicted.

The operation of the reflex mounting assemblies of the subject invention should be readily comprehended from the foregoing description of its features, but a few additional comments are worthwhile. It will be noted that when subjected to a downward force the hoop 11 causes the L-shaped bracket 44 to pivot towards the base plate 41. That pivoting is resisted by a force imparted by the resilient mass 47 between the horizontal portion 44*a* of the L-shaped bracket 44 and the face of the lower portion of the stationary base plate 41. The opposing force will increase as the L-shaped bracket 44 pivots downward, and upon termination of the downward force, the force provided by the resilient mass 47 will cause the hoop 11 to resume its normal horizontal position. It will be appreciated that the downward force to the hoop 11 usually will be terminated abruptly, and the hoop 11 may return to the normal position with considerable momentum. The upper portion 41*a* of the base plate 41, however, bears the impact of the vertical portion 44*b* of the L-shaped bracket 44 which otherwise eventually might cause damage to a relatively frangible backboard, such as one made from composite board.

While this invention has been disclosed and discussed primarily in terms of specific embodiments thereof, it is not intended to be limited thereto. Other modifications and embodiments will be apparent to the worker in the art.

I claim:

1. An assembly for reflexably mounting a normally horizontal basketball goal hoop to a vertical backboard, which reflex mounting assembly comprises:

(a) a base plate normally attached to the front face of said backboard;

(b) an L-shaped bracket which comprises a normally horizontal portion, to which a hoop is attached, and a normally vertical portion normally resting against the front face of the upper portion of said base plate;

(c) a hinge for pivotally connecting the lower edge of said normally vertical portion of said L-shaped bracket to an interior region of the front face of said base plate; and (d) a preloaded resilient mass disposed between the lower face of said normally horizontal portion of said L-shaped bracket and the front face of the lower portion of said base plate.

2. The reflex mounting assembly of claim 1, comprising:

(e) a pair of rigid braces disposed, respectively, between each side of said hoop and the corresponding side of said normally vertical portion of said L-shaped bracket.

3. The reflex mounting assembly of claim 2, wherein the pin of said hinge and said braces comprise an integral component of said mounting assembly and wherein at least one of the cooperating passageways of said hinge are integral parts of said vertical portion of said L-shaped bracket and said base plate.

4. The reflex mounting assembly of claim 3, wherein said preloaded resilient mass is composed of polyurethane.

5. In combination with a basketball backboard, the reflex mounting assembly of claim 4.

6. In combination with a basketball backboard, the reflex mounting assembly of claim 3.

7. The reflex mounting assembly of claim 2, wherein said preloaded resilient mass is composed of polyurethane.

8. In combination with backboard, the reflex mounting assembly of claim 7.

9. In combination with a basketball backboard, the reflex mounting assembly of claim 2.

10. The reflex mounting assembly of claim 1, wherein said preloaded resilient mass is composed of polyurethane.

11. In combination with a basketball backboard, the reflex mounting assembly of claim 10.

12. In combination with a basketball backboard, the reflex mounting assembly of claim 1.

* * * * *